US007065317B2

(12) United States Patent
Suda

(10) Patent No.: US 7,065,317 B2
(45) Date of Patent: Jun. 20, 2006

(54) REINFORCED CLEANING MEMBER, AND PROCESS CARTRIDGE AND IMAGE FORMING APPARATUS USING SAME

(75) Inventor: Takeo Suda, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 10/712,038

(22) Filed: Nov. 14, 2003

(65) Prior Publication Data

US 2004/0141781 A1 Jul. 22, 2004

(30) Foreign Application Priority Data

Nov. 14, 2002 (JP) ..... 2002-330521
Aug. 7, 2003 (JP) ..... 2003-288669

(51) Int. Cl.
*G03G 15/00* (2006.01)
*G03G 21/00* (2006.01)

(52) U.S. Cl. ..... 399/350

(58) Field of Classification Search ..... 399/350, 399/351

See application file for complete search history.

(56) References Cited

U.S. PATENT DOCUMENTS 5,517,294 A * 5/1996 Ogiri et al. ..... 399/351

FOREIGN PATENT DOCUMENTS

| | | | |
|---|---|---|---|
| JP | 07-056437 | | 3/1995 |
| JP | 11-174922 | | 7/1999 |
| JP | 11249514 A | * | 9/1999 |
| JP | 2000-132025 | | 5/2000 |
| JP | 2001-075454 | | 3/2001 |
| JP | 2001-125458 | | 5/2001 |
| JP | 2002-072828 | | 3/2002 |
| JP | 2002-214886 | | 7/2002 |

* cited by examiner

*Primary Examiner*—Quana Grainger
(74) *Attorney, Agent, or Firm*—Oblon, Spivak, McClelland, Maier & Neustadt, P.C.

(57) ABSTRACT

A cleaning member for cleaning an image carrier. The cleaning member includes a support plate having a planar face portion configured to be fixed to an object in a position adjacent to the image carrier, a plurality of reinforcement features configured to reinforce a strength of the support plate, at least one of the reinforcement features arranged on the planar face portion, and a blade connecting portion arranged on the planar face portion. The cleaning member further includes an elastic blade member connected to the blade connecting portion of the support plate such that the elastic blade extends toward the image carrier when the support plate is fixed to the object. The image cleaner may be positioned within an image forming apparatus or an image developing cartridge.

29 Claims, 8 Drawing Sheets

FIG. 4

| FORM | NOISE | CROSS SECTION TWO-DIMENTIONAL MOMENT ($mm^4$) |
|---|---|---|
| FIG. 3A | YES | 6.8 |
| FIG. 3B | YES | 140 |
| FIG. 3C | YES | 23.5 |
| FIG. 3D | NO | 51.7 |

REINFORCED CLEANING MEMBER, AND PROCESS CARTRIDGE AND IMAGE FORMING APPARATUS USING SAME

CROSS REFERENCE TO RELATED APPLICATIONS

This application claims priority to Japanese Application 2003-288669 filed on Aug. 7, 2003, and Japanese Application 2002-330521 filed on Nov. 14, 2002, the entire contents of which are incorporated by reference.

BACKGROUND OF THE INVENTION

1. Field of the Invention

The present invention generally relates to an image forming apparatus, such as a printer, or a facsimile device or a corresponding process cartridge, and more particularly relates to a cleaning member.

2. Description of the Related Art

In a conventional image forming apparatus, a cleaning member is used to remove excess developer from an image carrier, for example. The cleaning member is attached to a case of the apparatus and includes an elastic blade that is connected to a support plate having an attaching portion that is fixed to the case such that the elastic blade contacts the image carrier. The present inventors have recognized that a penetration length (generally measured from the attaching portion to the blade contact with the image carrier) and contact angle against image carrier are important to decide cleaning efficiency. Moreover, in processing a plate, accuracy of the cleaning member contact to the image carrier decreases according to the amount of processing done on the plate. Still further it is generally known that a fold portion and/or a convex portion on the support plate are used to add strength to the plate member.

Japanese patent laid-open No. Hei7-175393 discloses a cleaning member in which the support plate has at least one fold portion between the blade and the attaching part to add strength. While this configuration maintains a good toner removing efficiency for high speed machines, it decreases the accuracy of blade contact on the image carrier. Similarly, Japanese patent laid-open No2002-214886 discloses another cleaning member in which a support plate member has a convex portion made by a pressing process, which adds strength to the cleaning member. However, this reference does not address the need for accuracy of blade contact with the image carrier. Because the cleaning member of the above described publications do not provide accurate contact between the blade and image carrier, the devices disclosed therein generally do not remove toner from the image carrier correctly. Moreover, the present inventors have recognized that inaccuracy of the contact point between the blade and image carrier may undesirably transform the image carrier.

Furthermore, it is generally known that when a cleaning blade non-uniformly contacts an image carrier, undesirable noise results, perhaps due to oscillations of the cleaning blade. There have been many suggestions of how to prevent such noises. For example, use of interior heavy goods, an elastic member, a vibration absorption member are well-known methods of attempting to prevent noise caused by oscillation of the cleaning member. However, it has been difficult to completely prevent noises because of the many factors that contribute to this problem, which include a photoreceptor structure, a toner type, and a cleaning blade type, as well as temperature and humidity of the operating environment.

SUMMARY OF THE INVENTION

The present invention has been developed in order to address at least the above-mentioned problems.

It is an object of the present invention to provide a cleaning member, process cartridge and image forming apparatus that improve the accuracy of contact between the cleaning blade and image carrier.

It is yet another object of the present invention to provide a cleaning member, process cartridge and image forming apparatus that prevent or reduce noises occurring from oscillation of the cleaning blade.

These and other objects of the present invention may be provided by a cleaning member for cleaning an image carrier. The cleaning member includes a support plate having a planar face portion configured to be fixed to an object in a position adjacent to the image carrier, a plurality of reinforcement features configured to reinforce a strength of the support plate, at least one of the reinforcement features arranged on the planar face portion, and a blade connecting portion arranged on the planar face portion. The cleaning member further includes an elastic blade member connected to the blade connecting portion of the support plate such that the elastic blade extends toward the image carrier when the support plate is fixed to the object.

Another aspect of the invention provides an image forming apparatus or an image processing cartridge having an image carrier, an interior wall and a cleaning member mounted to the interior wall and configured to clean the image carrier. The cleaning member includes a support plate having a planar face portion configured to be fixed to the interior wall in a position adjacent to the image carrier, a plurality of reinforcement features configured to reinforce a strength of the support plate, at least one of the reinforcement features arranged on the planar face portion, and a blade connecting portion arranged on the planar face portion. The cleaning member also includes an elastic blade member connected to the blade connecting portion of the support plate such that the elastic blade extends toward the image carrier when the support plate is fixed to the object.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 shows a table comparing the cleaning members of FIGS. 3A–3D by noise and cross section two-dimensional moment of holder member;

DETAILED DESCRIPTION OF THE PREFERRED EMBODIMENTS

A cleaning member, image process cartridge, and image forming apparatus of the present invention will be explained below with the reference to the accompanying drawings. The invention will be explained with reference to a process cartridge; however, it is to be understood that the invention can be applied to an image forming apparatus without using a process cartridge.

Figure 1A:
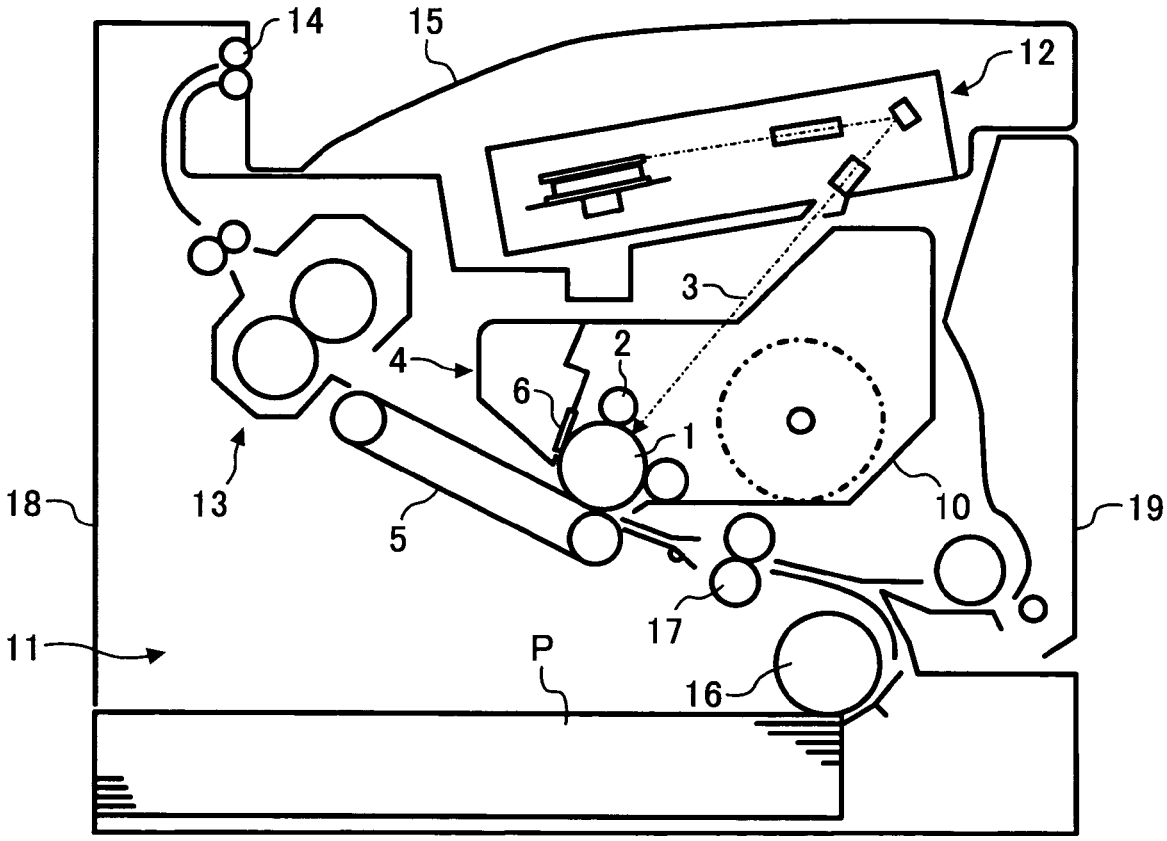
FIG. 1(A) shows an interior construction of an image forming apparatus according to one embodiment of the present invention.

Referring now to the drawings, FIG. 1A shows an outline constitution of a printer according to an embodiment of the present invention. As seen in this figure, the image forming apparatus 18 includes an image carrier 1, charging device 2, a light 3 from laser writing unit 12, a developing device 4, a transfer device 5, and a cleaning member 6. The embodiment of FIG. 1A includes a process cartridge 10 which includes the image carrier 1, charging device 2, developing device 4 and cleaning member 6 in one unit. In addition, the apparatus includes paper feed 11, fixing device 13, a pair of eject rollers 14, eject part 15, paper feed roller 16, a pair of conveying roller pairs 17, and a cover 19.

Figure 1B:
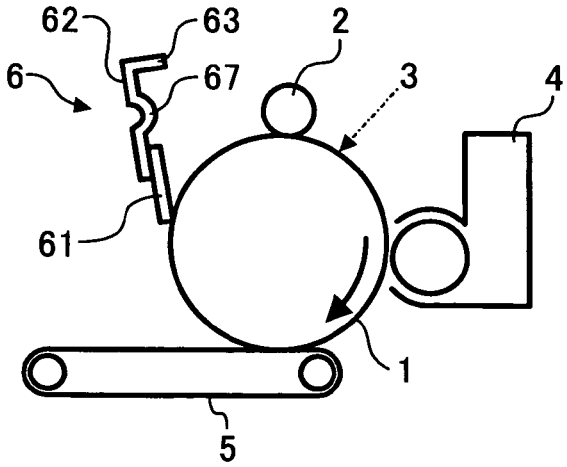
FIG. 1(B) shows a cross-section of a process cartridge according to an embodiment of the present invention.

In operation, image carrier 1 is rotated in the direction of the mark shown in FIG. 1B by a drive means (not illustrated). The surface of image carrier 1 is uniformly charged by charging device 2 and a latent image is then formed on the surface of the image carrier 1 by a light 3. The latent image is made a visible image by the developing device 4. The visible image on the image carrier 1 is then transferred to paper which is conveyed from the paper feed part 11, paper feed roller 16 and through conveying roller 17 to transfer device 5.

After transferring the developed image to paper, the remaining toner on the surface of image carrier 1 is removed by contacting a cleaning member 6 to image carrier 1. Details of the cleaning member 6 in relation to the process cartridge 10 are shown in FIG. 1B. As seen in this figure, cleaning member 6 is composed of elastic blade member 61 configured to remove a remaining toner, and support plate member 62 configured to fix elastic blade member 61 to the printer, for example. The elastic blade member 61 is fixed to support plate member 62 by using adhesion bond or a melting process. As seen in FIG. 1B, the support plate member 62 is bent to add strength. The support plate has a fold portion 63 that is bent at an end of the support member opposite to fixing elasticity blade member 61. The fold portion is substantially parallel to an axis of the image carrier. In addition, the support plate 62 includes a reinforcement portion 67 to further strengthen the support plate 62.

Figure 1C:
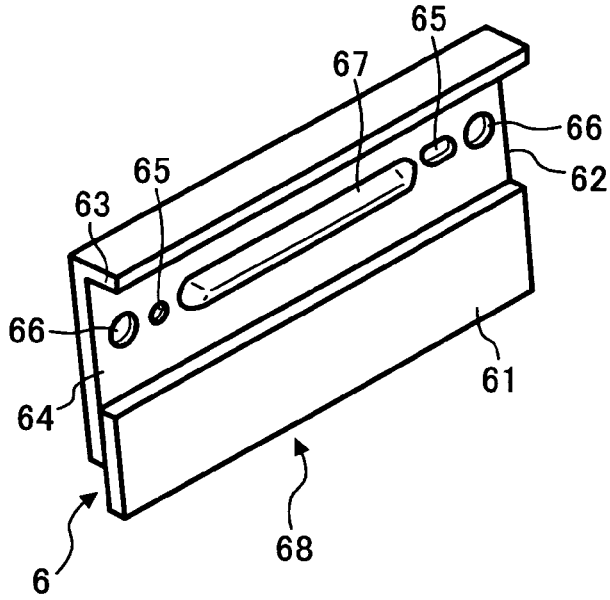
FIG. 1(C) shows perspective view of a cleaning member according to an embodiment of the present invention.
Figure 1D:
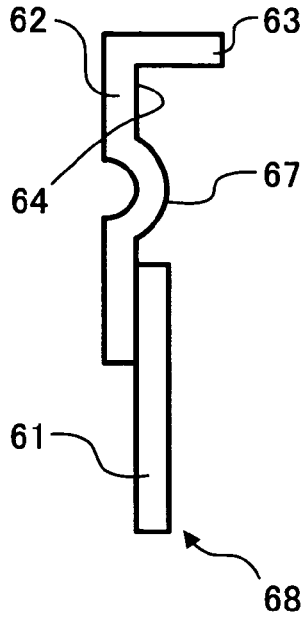
FIG. 1(D) shows a cross-section figure of the cleaning member of FIG. 1(C)

FIG. 1(C) is a perspective view showing details of the cleaning member 6. A fix face portion 64 of the support plate member 62 has a registration hole 65 and a fixing hole 66 against the process cartridge 10. The fix plate portion also provides a surface where the elastic blade member 61 is attached. Reference designation 68 shows contacting point that elasticity blade member 61 contacts image carrier 1. Furthermore, the fix face portion 64 has a reinforcement portion 67 to add strength to support plate member 62. The reinforcement portion has a semicircle recess cavity that forms a convex projection that extends along a fixing site of blade member 61. The reinforcement portion 67 extends substantially along an axis of the image carrier. In other words, a convex projection of the reinforcement portion 67, the registration hole 65 and fixing hole 66 are on the same fix face portion 64. As shown in FIG. 1D, the reinforcement portion 67 is formed between registration holes 65 and fixing holes 66. In detail, it is preferable that the reinforcement portion 67 is substantially centered between the registration holes 65 and fixing holes 66.

The present inventors have recognized that if a support plate member 62 will be made of thin and cheap member, noises occur because of its weak strength. Use of a thick member to increase strength has been proposed, but this would increase cost and weight of a process cartridge. Furthermore, a complicated structure of the process cartridge would be needed to fix a thick member. In the embodiment of the present invention, the fix face portion 64 to fix the elastic blade member 61 and reinforcement member 67 are disposed on the same face to substantially prevent noises, even if it uses a thin and cheap member.

Figure 2:
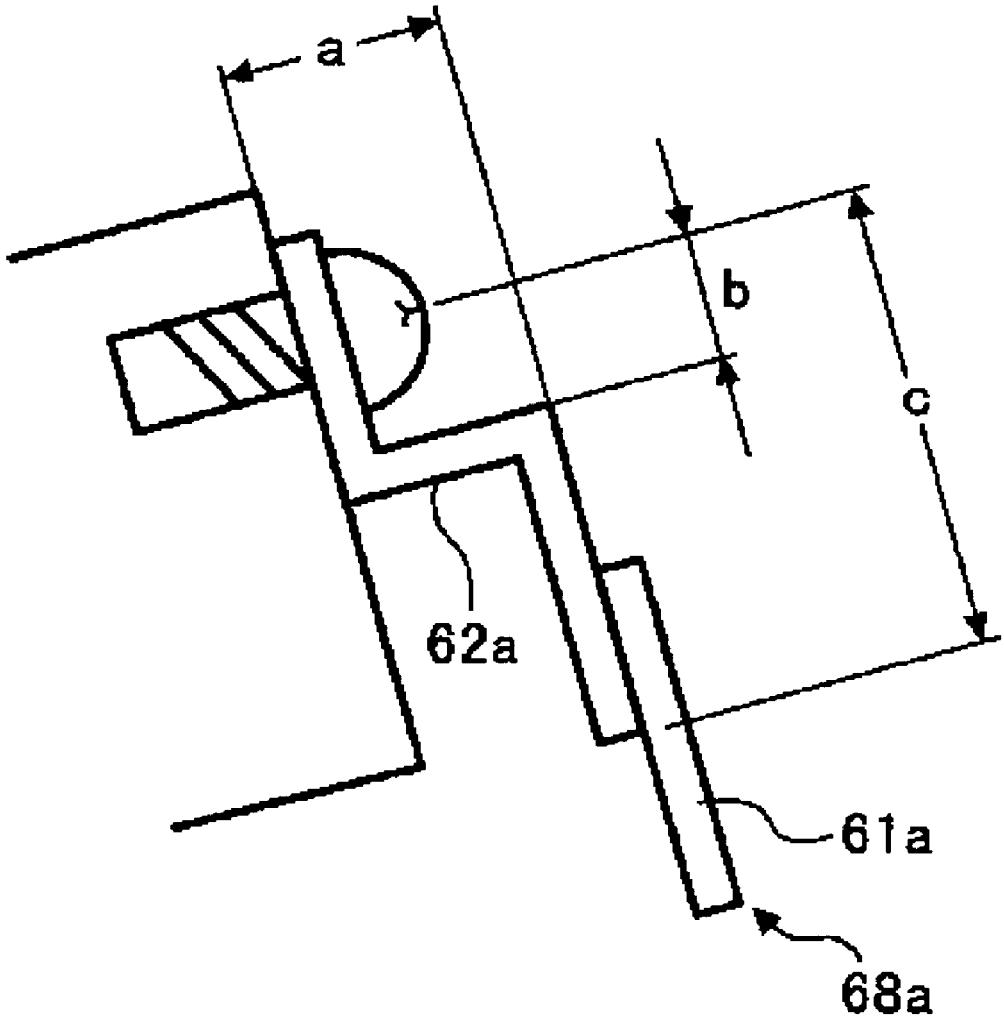
FIG. 2 BACKGROUND ART
FIG. 2 shows a conventional cleaning member.

FIG. 2 shows a conventional cleaning member. As seen in this figure, a fixing hole is not formed on the same face of the support plate member 62*a* that elastic blade member 61*a* is fixed. Thus, variations in distances a, b and c will add to a cumulative mismatched difference in the relative position of opposing edges of the cleaning member. This large mismatched difference makes it hard to maintain accuracy of distance from contacting point 68*a* that elasticity blade member contacts image carrier 1. With the present invention, reinforcement portion 67, the registration hole 65 and fixing hole 66 are on the same face of the fix face portion 64, which can prevent increasing mismatched differences. Therefore, the present invention can maintain accuracy of distance from contacting point 68 and uniformity of contact, to be effective to prevent or reduce noises. In addition, by attaching said cleaning member 6 to image forming apparatus or process cartridge 10 which including image carrier 1 and developing device 4, reliability will improve.

It is to be understood that the invention described in FIGS. 1A–1D is exemplary only and variations in the structure may be made without departing from spirit of the present invention. For example, a cross-section of reinforcement portion 67 is not limited to an example of FIGS. 1A–1D and may adopt various cross-sections type; such as a trench type shown J.P. 7-175393. In addition, while the reinforcement function device 67 is described as formed by a process of pressing, other processing may be used.

EXPERIMENT EXAMPLE

Figure 3A:
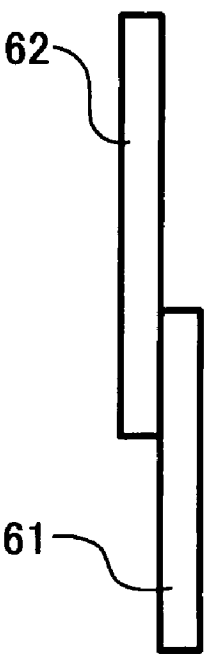
FIG. 3(A) shows comparative example of a cleaning member.
Figure 3B:
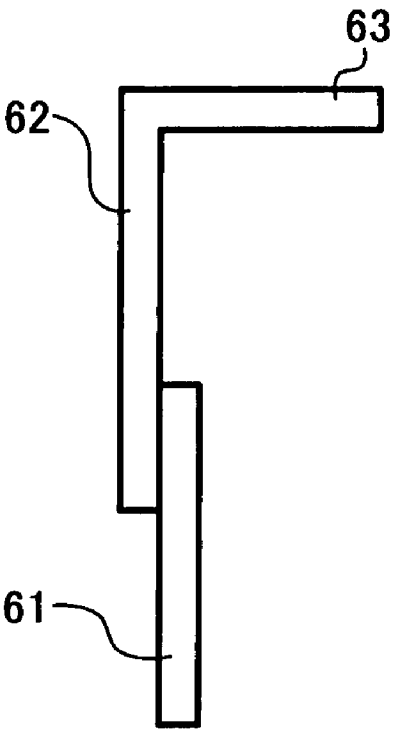
FIG. 3(B) shows another comparative example of a cleaning member.
Figure 3C:
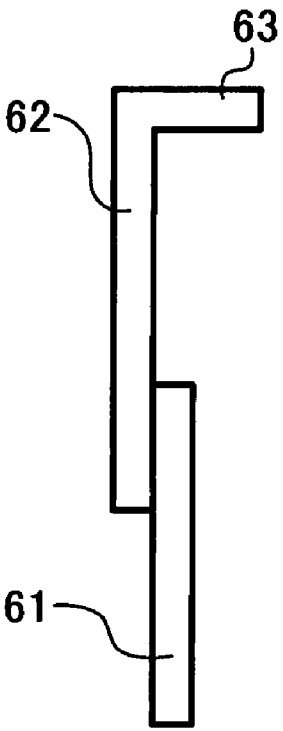
FIG. 3(C) shows another comparative example of a cleaning member.
Figure 3D:
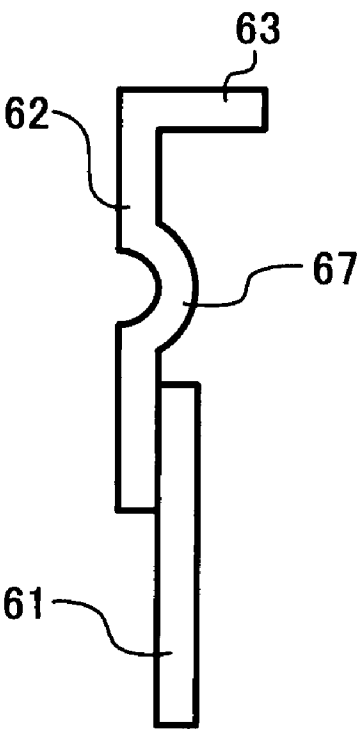
FIG. 3(D) shows a cleaning member in accordance with an embodiment of the present invention.

The present inventors conducted experiments on apparatus having a charging device 2 as a charging roller (DC bias 1500V), an image carrier 1 as an OPC drum (diameter 60 mm, rotation speed 250 mm/second), and a developing device 4 as a two ingredient dry development device. The image forming apparatus used for the experiments was an image forming apparatus made by Ricoh Corporation and having a product name "imagioNEO350." The cleaning members 6 of FIGS. 3(A), (B), (C) and (D) were used in the experiment. FIG. 3(D) is an embodiment of the present invention. FIG. 3(C) is a cleaning member having removing reinforcement portion 67 removed from FIG. 3(D); FIG. 3(A) is a cleaning member having reinforcement portion 67 and fold portion 63 removed from FIG. 3(D); and FIG. 3(B) has a larger fold portion 63 than FIG. 3(C). The elastic blade member 61 of cleaning member shown in FIGS. 3(A), (B), (C) and (D) has a hardness 70°, and a polyurethane rubber blade with thickness 2 mm. The support plate 62 use zinc metal plate with a thickness of 1.6 mm. Adhesion of elasticity blade member 61 with support plate member 62 is was provided by a heat melting process.

In order to evaluate the differences of the cleaning members of FIGS. 3A–3D, the present inventors printed a single page every five seconds using apparatus having each of the cleaning members of FIGS. 3A–3D. The inventors then listened to noises corresponding to the above-described oscillation after 2000 pieces were printed. The result is shown in FIG. 4. As seen in this figure, noises occurred in FIGS. 3(A), (B) and (C). However, in the embodiment of the present invention in FIG. 3(D) noises do not occur. As for comparing the strength of holding members, the present inventors measured cross section two-dimensional moment of each holder. The results are also shown in FIG. 4. It is understood from FIG. 4 that simply adding strength cannot prevent noises. Thus, it is very effective to form reinforcement portion 67 on the same face that elasticity blade member 61 is adhered to support plate 62, as taught by the present invention. Furthermore, it became clear that a big effect of preventing noises is achieved by making a value of a cross section two-dimensional more than 50 $mm^4$.

Figure 5B:
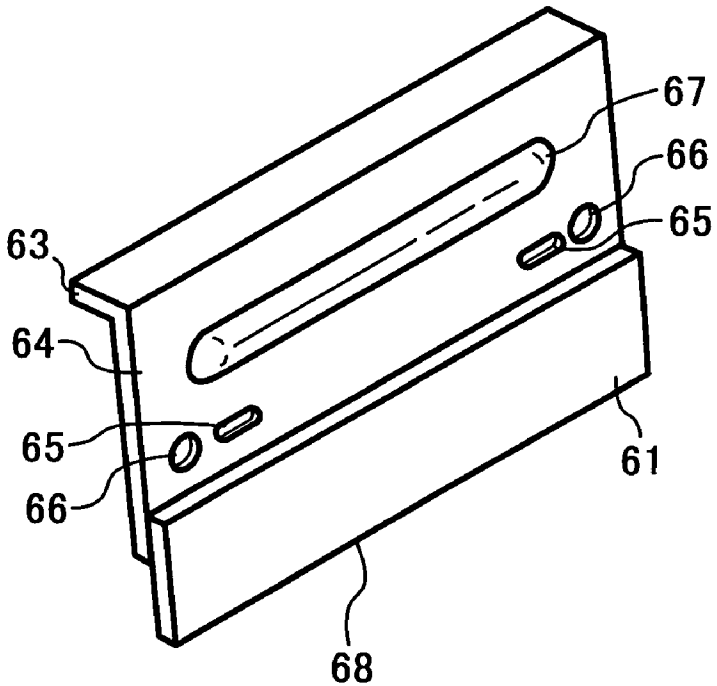
FIG. 5(B) shows a cleaning member in accordance with an embodiment of the present invention.
Figure 5A:
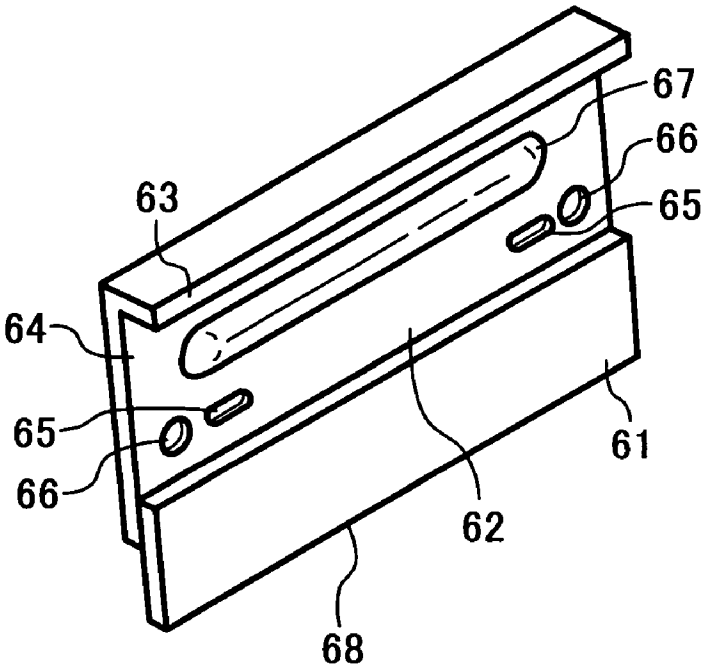
FIG. 5(A) shows a cleaning member in accordance with an embodiment of the present invention.

FIGS. 5A and 5B show another embodiment of the present invention. As shown in FIGS. 5(A) and (B), the reinforcement portion 67 may be formed apart from registration holes 65 and fixing holes 66 in the vertical direction with reference to an axis of the image carrier 1. However, in this embodiment of the invention, the effect on preventing noises becomes reduced.

Figure 6:
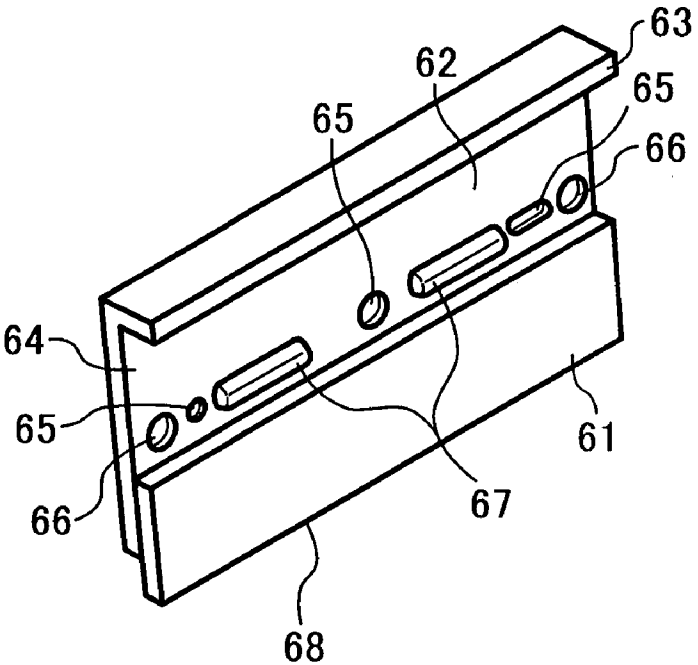
FIG. 6 shows an alternative embodiment of the cleaning member of FIG. 5.

FIG. 6 shows a variation of the present invention. As seen in this figure, the reinforcement function part 67 can be formed with plural pieces along an axial direction of the image carrier 1. However, in this case, a deformation of the cleaning member will become larger because of increased processing of the member. Specifically, a flatness accuracy of fix face portion 64 of support portion 62 may be reduced, or a deformation may concentrate on the weak portion which may occur whether reinforcement portion exists or not. Therefore, it is preferable that reinforcement portion 67 is continually formed. However when there is need to form plural pieces of reinforcement portion 67, fixing holes 66 are preferably formed between reinforcement portion 67 in order to reduce deformation. In this case, reinforcement portion 67 is formed substantially in the center of two fixing holes 66, so that it can prevent oscillation in the center of the two fixing holes 66.

Figure 7B:
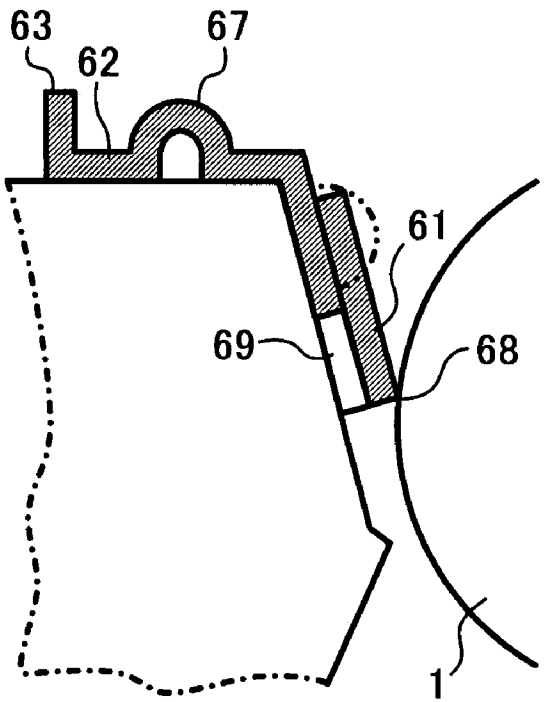
FIG. 7(B) shows cross-section figure of cleaning member of FIG. 7A.
Figure 7A:
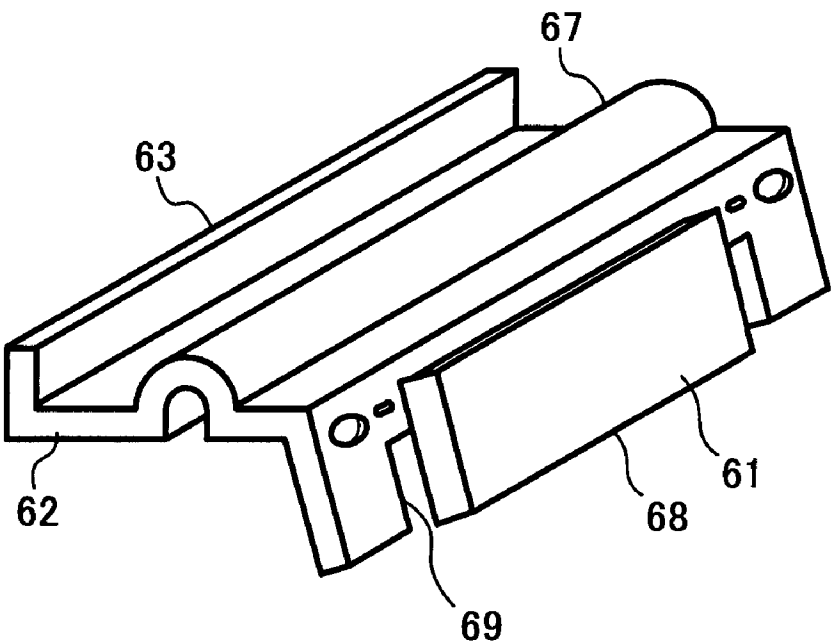
FIG. 7(A) shows expansion figure of cleaning member in accordance with another embodiment of present invention.

FIG. 7 shows expansion FIG. (A) and cross-section FIG. (B) of a cleaning member in accordance with another embodiment of present invention. The cleaning member 6 has a construction in which the support plate 62 is bent between one end having a portion to fix an elastic blade member 61 and the reinforcement portion 67. It is bent in the direction along the axis of image carrier 1, so that an angle is formed between the end and the reinforcement portion.

Reinforcement portion 67 having a convex portion is formed between fold portion 63 and a portion which has been bent along substantially all of the width of support plate member 62 in an axial direction of the image carrier 1. This reinforcement portion 67 is not formed between registration holes 65 and fixing holes 66, which is different from former embodiment.

Furthermore, a cut portion 69 is formed by cutting the end of the support plate 62 that is contacting the image carrier 1, so contacting point 68 of a elasticity blade member 61 needs not to project from the end of support plate 62. This embodiment can make space smaller than the above-described embodiments. Even if contacting point 68 retreats from a cut portion 69, it can contact the image carrier 1. Thus, it seems to be understood from FIG. 7(B) that a configuration of this figure can get the same effect as the above-described embodiments.

Figure 8:
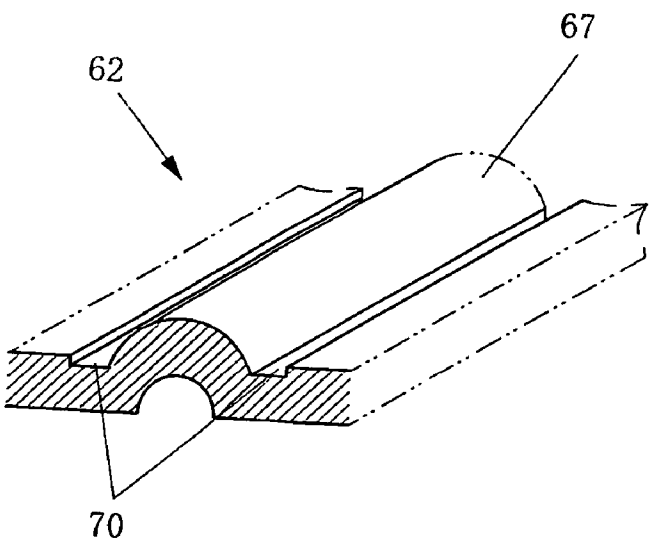
FIG. 8 shows an expansion figure of a cleaning member according to yet another embodiment of the present invention.

FIG. 8 shows an expansion figure of a cleaning member according to another embodiment of the present invention. Cleaning member 6 of this embodiment can be adapted to any of the above-described embodiments. As seen in FIG. 8, there is a groove portion 70 along the convex portion of reinforcement portion 67 in the direction the axis of image carrier 1. When reinforcement portion 67 is formed on support plate member 62, support plate member 62 is pulled. Especially, in the embodiment of FIGS. 1A–1D, there is not a reinforcement portion 67 along all the width in the direction along the axis of image carrier 1. Therefore, a strength of pulling force on the support plate member 62 is different along portions having reinforcement portion 67. Moreover, the distance from contacting point 68 of elasticity blade member 61 to the end of support plate member 62 varies along portions where the reinforcement portion 67 is or not. This variation prevents proper cleaning by elasticity blade member 61. The embodiment of FIG. 8 solves or reduces this problem by forming groove portion. In addition, it is preferable to form groove portion 70 on either side of reinforcement portion 67.

Numerous modifications and variations of the present invention are possible in light of the above teachings. It is therefore to be understood that, within the scope of the appended claims, the invention may be practiced otherwise than as specifically described herein.

The invention claimed is:

1. A cleaning member for cleaning an image carrier, comprising: a support plate comprising:

a planar face portion configured to be fixed to an object in a position adjacent to said image carrier, a fold portion forming a plane that extends at an angle to said planar face portion, a reinforcement feature configured to reinforce a strength of said support plate, said reinforcement feature being integral with and arranged on said planar face portion, and a blade connecting portion coupled to said planar face portion; and an elastic blade member connected to said blade connecting portion of said support plate such that said elastic blade extends toward said image carrier when said support plate is fixed to said object.

2. The cleaning member of claim 1, wherein said object is an interior surface of an image forming apparatus.

3. The cleaning member of claim 1, wherein said object is an interior surface of an image processing cartridge.

4. The cleaning member of claim 1, further comprising a plurality of fixing holes extending through said support plate and configured to receive a screw that fixes the support plate to said object.

5. The cleaning member of claim 1, further comprising a plurality of registration holes extending through said support plate and configured to align said support plate on said object.

6. The cleaning member of claim 1, wherein said reinforcement feature comprises a convex shaped protrusion extending from said planar face of said support plate; and said fold portion comprises a fold portion forming a plane that extends substantially at a right angle to said planar face portion.

7. The cleaning member of claim 6, wherein said fold portion extends in a direction of said convex shaped protrusion such that the folded portion, convex shaped protrusion and said blade connecting portion all are formed on said planar face portion.

8. The cleaning member of claim 6, wherein said fold portion extends in a direction opposite of said convex shaped protrusion such that the folded portion is arranged on an opposite face to said planar face portion that said protrusion and blade connecting portion are formed on.

9. The cleaning member of claim 6, wherein:

said fold portion is positioned on an edge of said planar face portion, said elastic blade is connected to an opposite edge of the planar face portion, and said convex shaped protrusion is positioned between said edge and opposite edge.

10. The cleaning member of claim 9, further comprising fixing holes positioned on opposite ends of said convex shaped protrusion.

11. The cleaning member of claim 10, wherein said fixing holes are substantially aligned with said convex shaped protrusion to form an array extending along said edge and opposite edge.

12. The cleaning member of claim 10, wherein said fixing holes are offset from said convex shaped protrusion in a direction extending from said edge to said opposite edge.

13. The cleaning member of claim 10, wherein said convex shaped protrusion is substantially centered between said fixing holes.

14. The cleaning member of claim 10, further comprising registration holes substantially aligned with said fixing holes to form an array extending along said edge and opposite edge.

15. The cleaning member of claim 10 wherein said convex shaped protrusion comprises a continuous convex shaped protrusion that extends along said edge and opposite edge.

16. The cleaning member of claim 10, wherein said convex shaped protrusion comprises a plurality of discreet convex shaped protrusions aligned on said planar face portion.

17. The cleaning member of claim 16, further comprising at least one fixing hole positioned between said plurality of convex shaped protrusions.

18. A cleaning member for cleaning an image carrier comprising:

a support plate comprising:

a planar face portion configured to be fixed to an object in a position adjacent to said image carrier, a plurality of reinforcement features configured to reinforce a strength of said support plate, at least one of said reinforcement features being integral with and arranged on said planar face portion, and a blade connecting portion arranged on said planar face portion; and an elastic blade member connected to said blade connecting portion of said support plate such that said elastic blade extends toward said image carrier when said support plate is fixed to said object, wherein at least one of said reinforcement features is positioned on said planar face to extend in an axial direction of said image carrier when said support plate is fixed to said object.

19. The cleaning member of claim 6, further comprising a groove portion arranged along at least one side of said convex shaped protrusion to relieve a mechanical stress on said support plate when said convex shaped protrusion is formed in said support plate.

20. The cleaning member of claim 9, further comprising a bend formed between said convex shaped protrusion and said edge having said elastic blade formed thereon.

21. The cleaning member of claim 20, further comprising a cut out portion positioned along said edge and configured to receive said elastic blade.

22. A cleaning member for cleaning an image carrier, comprising:

a support plate comprising:

a planar face portion configured to be fixed to an object in a position adjacent to said image carrier, a plurality of reinforcement features configured to reinforce a strength of said support plate, at least one of said reinforcement features arranged on said planar face portion, and a blade connecting portion arranged on said planar face portion; and an elastic blade member connected to said blade connecting portion of said support plate such that said elastic blade extends toward said image carrier when said support plate is fixed to said object, wherein the cross section second moment of the support plate containing the reinforcement member is 50 $mm^4$ or more.

23. A cleaning member for cleaning an image carrier, comprising:

a support plate comprising:

means for fixing the support plate to an object in a position adjacent to said image carrier, and a fold portion forming a plane that extends at an angle to a plane of said support plate, means integral with and arranged on said plane of the support plate, for reinforcing a strength of said support plate;

an elastic blade member configured to clean said image carrier when said support plate is fixed to said object; and means for connecting said elastic blade to said support plate.

24. A cleaning member for cleaning an image carrier, comprising:

a support plate comprising:

means for fixing the support plate to an object in a position adjacent to said image carrier, and means arranged on a plane of the support plate, for reinforcing a strength of said support plate;

an elastic blade member configured to clean said image carrier when said support plate is fixed to said object;

means for connecting said elastic blade to said support plate; and means for aligning said support plate on said object.

25. The cleaning member of claim 23, further comprising means for relieving a mechanical stress on said support plate when a convex shaped protrusion is formed in said support plate.

26. An image forming apparatus comprising:

an image carrier;

an interior wall; and a cleaning member mounted to said interior wall and configured to clean said image carrier, said cleaning member comprising:

a support plate comprising:

a planar face portion configured to be fixed to said interior wall in a position adjacent to said image carrier, a fold portion forming a plane that extends at an angle to said planar face portion, reinforcement feature configured to reinforce a strength of said support plate, said reinforcement feature being integral with and arranged on said planar face portion, and a blade connecting portion coupled to said planar face portion; and an elastic blade member connected to said blade connecting portion of said support plate such that said elastic blade extends toward said image carrier when said support plate is fixed to said interior wall.

27. An image processing cartridge, comprising:

an image carrier;

an interior wall; and a cleaning member mounted to said interior wall and configured to clean said image carrier, said cleaning member comprising:

a support plate comprising:

a planar face portion configured to be fixed to said interior wall in a position adjacent to said image carrier, a fold portion forming a plane that extends at an angle to said planar face portion, reinforcement feature configured to reinforce a strength of said support plate, said reinforcement feature being integral with and arranged on said planar face portion, and a blade connecting portion coupled to said planar face portion; and an elastic blade member connected to said blade connecting portion of said support plate such that said elastic blade extends toward said image carrier when said support plate is fixed to said interior wall.

28. The cleaning member of claim 1, wherein said blade connecting portion is arranged on said planar face portion.

29. The cleaning member of claim 1, wherein said blade connecting portion is arranged on a surface that extends at an angle from the planar face portion.

* * * * *